United States Patent [19]

Shepard et al.

[11] 4,111,030

[45] Sep. 5, 1978

[54] PRESS CUSHION

[75] Inventors: Lynn R. Shepard, Berea; John B. Terrell, Solon, both of Ohio

[73] Assignee: Teledyne Industries, Inc., Cleveland, Ohio

[21] Appl. No.: 787,990

[22] Filed: Apr. 15, 1977

[51] Int. Cl.[2] ..... B21D 22/22

[52] U.S. Cl. ..... 72/351; 72/361; 72/465; 267/119

[58] Field of Search ..... 72/350, 351, 352, 361, 72/457, 465; 92/106, 163, 164; 267/119

[56] References Cited

U.S. PATENT DOCUMENTS

| | | | |
|---|---|---|---|
| 2,322,440 | 6/1943 | Highberg et al. | 92/106 X |
| 2,420,626 | 5/1947 | Stevenson | 92/106 |
| 2,536,565 | 1/1951 | Ostergren | 92/106 |
| 2,568,092 | 9/1951 | Sloan et al. | 92/106 X |
| 2,987,046 | 6/1961 | Atherton | 92/163 |
| 3,013,791 | 12/1961 | Gold et al. | 267/119 |
| 3,019,739 | 2/1962 | Prosser | 92/168 |
| 3,101,194 | 8/1963 | Hennells | 267/119 |
| 3,157,095 | 11/1964 | Heiser | 267/119 |
| 3,267,677 | 8/1966 | Bollar | 267/119 |
| 3,375,001 | 3/1968 | Hennells | 267/119 |
| 3,380,350 | 4/1968 | Stewert | 92/106 |
| 3,490,757 | 1/1970 | Haanes | 267/119 |
| 3,914,978 | 10/1975 | Sekanina et al. | 72/465 |

*Primary Examiner*—E. M. Combs

[57] ABSTRACT

An improved press cushion includes a piston which is disposed within a cylinder chamber. The head end of the cylinder chamber is arranged for communication with a compressed fluid, such as nitrogen gas. The rod end of the cylinder chamber is arranged for communication with a source of air which is free of contaminants found in the immediate environment of the cylinder assembly. Although clean air could be obtained from the atmosphere at a location spaced from the press, the rod end of the cylinder is advantageously connected to a low pressure supply of clean air.

5 Claims, 8 Drawing Figures

PRESS CUSHION

BACKGROUND OF THE INVENTION

The present invention relates to an improved press cushion and, more specifically to a press cushion cylinder assembly with a vented rod end chamber connected with a source of clean air.

The use of a cylinder assembly as a press cushion is well known. Originally, helical coil springs were used in dies for the purpose intended herein, e.g. restraining the workpiece from movement prior to the die contacting the part fully and assisting in returning the workpiece and the die portions to their original positions. In many instances, cylinder assemblies have replaced the helical springs.

These known press cushion cylinder assemblies are equipped with a means to supply fluid under pressure (air, gas, or hydraulic) to the head end of the cylinder chamber. The opposite or rod end of the cylinder chamber is generally vented to atmosphere. A problem occurs in presses using typical die cushion cylinder assemblies when foreign materials are drawn into the rod end chamber from the environment around the press. For example, fluids termed drawing compounds which are used as a lubricant on the material being processed, may literally flood over the die cylinders. This drawing compound and other particles can be inspirated into the vents on the die cylinders and when drawn in, can cause failure of the seals and other components of the die cylinder assembly.

Various piston and cylinder assemblies utilized in association with presses are disclosed in U.S. Pat. Nos. 3,013,791; 3,157,095; 3,267,677; 3,375,001; and 3,490,757. These known assemblies do not contemplate that clean air from a source of low pressure air or from an environment spaced apart from the press will be supplied to an expanding cylinder chamber during operation of the press. In addition, a piston and cylinder assembly for pumping fluid is disclosed in U.S. Pat. No. 3,019,739.

SUMMARY OF THE PRESENT INVENTION

The present invention provides a new and improved cylinder assembly which is used as a press cushion and has an improved mode of operation. As the press is operated, a suitable fluid, such as nitrogen gas, is compressed in the head end cylinder chamber. This provides a force which holds a workpiece against movement during a working stroke of a die. As the nitrogen gas is compressed, air is conducted to the expanding rod end cylinder chamber.

Damage to the cylinder assembly and the seals therein from foreign matter admitted to the cylinder along with the air is avoided by connecting the rod end cylinder chamber with a source of clean air. This clean air may be supplied from the atmosphere at a location remote from the press. As an alternative to supplying air at atmospheric pressure, clean air or other fluid can be supplied from a tank or other source at a relatively low pressure.

Accordingly, it is an object of this invention to provide a new and improved press cushion cylinder assembly which obtains the necessary influx of air or other fluid to an expanding cylinder chamber through a fluid connection sealed from a contaminated environment adjacent to the press.

Another object of this invention is to provide a new and improved press cushion cylinder assembly which is connected with a low pressure clean air supply.

Another object of this invention is to provide an improved method of operating a press cushion cylinder assembly by supplying an expanding chamber of the cushion cylinder assembly with fluid which is free of contaminants found in the environment around the press.

BRIEF DESCRIPTION OF THE DRAWINGS

The foregoing and other objects and features of the present invention will become more apparent upon a consideration of the following description taken in connection with the accompanying drawings wherein.

DESCRIPTION OF THE SPECIFIC PREFERRED EMBODIMENTS OF THE INVENTION

Figure 1:
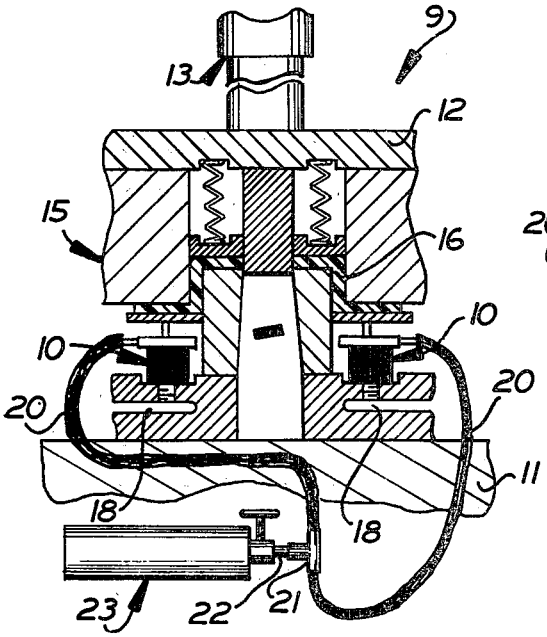
FIG. 1 is a front plan view of a die press using cushion cylinder assemblies constructed in accordance with the present invention.

Press cushion cylinder assemblies 10, constructed in accordance with the present invention are shown in a typical installation in FIG. 1. A press 9 has a lower platen 11 and upper platen 12. A main cylinder 13 or other suitable means is provided to cause relative movement between the lower and upper platens 11 and 12. A die set 15 is releasably fixed in position between the lower 11 and upper 12 platens. The specific details of the die set 15 are not important in this particular disclosure, but briefly upper and lower dies are moved relative to each other to form a workpiece 16 when the platens 11 and 12 are moved relative to one another.

Understandably, metal particles and chips are frequently present within the press and die area. Further, it is often desirable to utilize drawing compounds, commonly liquids, to promote higher quality products. The shavings, chips and liquids within the die area are considered contaminants after being disbursed either purposely, as in the case of the liquid, or unpurposely, as in the case of the shavings and chips.

Although the cushion cylinder assemblies 10 could be mounted in many different locations, FIG. 1 illustrates cylinder assemblies 10 as being mounted in the lower portion of the press 9, to support the workpiece 16 and hold it against movement during a forming operation. The base of the press includes passages 18 which are used to provide the pressurized fluid to head end chambers of the cushion cylinder assemblies 10. The cylinder assemblies 10 are positioned between the workpiece 16 and the die 15 resulting in the compression of a fluid, such as nitrogen gas, in the head end chambers of the cushion cylinder assemblies 10 as the press moves the platens 11 and 12 together.

A tube 20, preferably of a flexible material, is attached to each cylinder assembly 10 for the purpose of providing an influx of clean air or other fluid to the expanding rod end chambers of the cushion cylinder assemblies. While the tubes, one for each cushion cylinder assembly, may be left open to a source of clean air at a location spaced from the press, the tubes are preferably connected together, as indicated at the connection 21. The connection 21 is attached to a second tube 22 directed to a container 23 of clean air or other fluid. The fluid in the container 23 is substantially free of contaminants detrimental to the cylinder assemblies 10. The air in the container is advantageously at a pressure which is somewhat greater than atmospheric pressure to positively prevent the inspiration of air from the environment around the press into the expanding rod end chambers of the cylinder assemblies 10.

Figure 2:
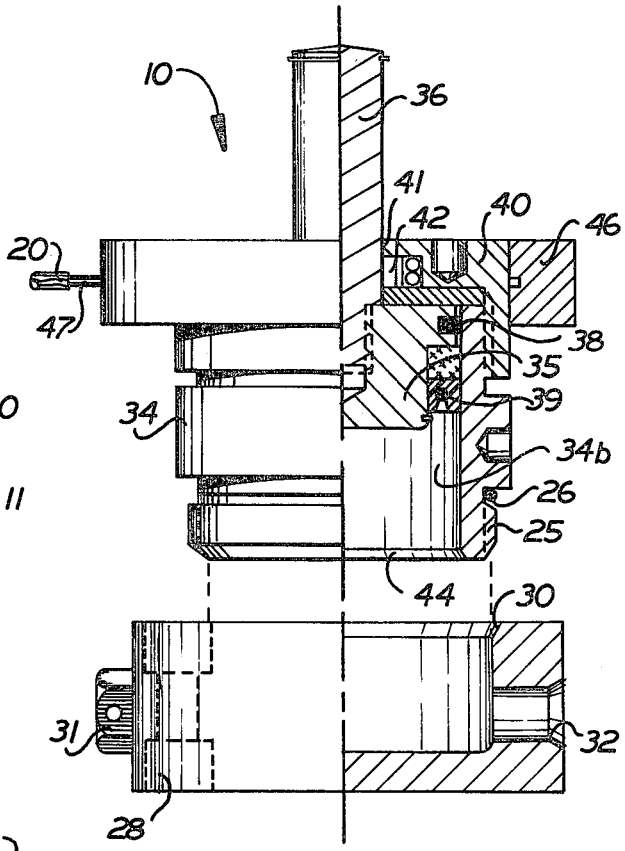
FIG. 2 is a partially broken away and exploded illustration on an enlarged scale of a press cushion cylinder assembly utilized in the press of FIG. 1, the cylinder assembly being shown in a fully extended condition.
Figure 3:
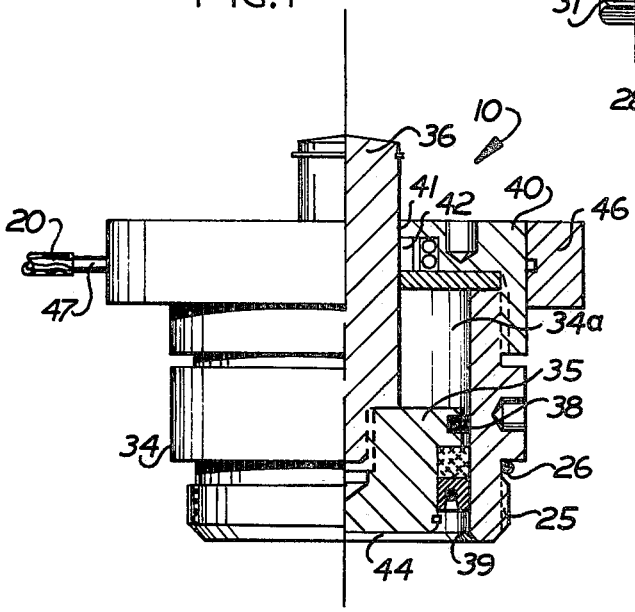
FIG. 3 is a partially broken away illustration of the cylinder assembly of FIG. 2, the cylinder assembly being shown in a fully retracted condition.

The details of a cylinder assembly 10 is more readily apparent through a discussion involving FIGS. 2 and 3. The cylinder assembly 10 is constructed with a threaded portion 25. A seal, such as an O-ring 26, is also provided. While the cylinder assembly 10 is capable of being threaded directly into the die, a separate adapter 28 is shown in FIG. 2. The adapter 28 has internal threads 29, corresponding to the threaded portion 25 on the cylinder assembly 10. The adapter 28 also has a seat 30 which is intended to seal the cylinder 10 to the adapter by reason of the O-ring 26 when the two have been threaded together.

Fluid such as nitrogen gas, at a relatively high pressure, is connected to the adapter 28. A first fitting 31 is provided on the adapter 28 for connection to the high pressure fluid supply. A second fitting 32 may be provided for the purpose of interconnecting adapters to a single high pressure fluid supply.

Although the cylinder assembly 10 discussed herein deals exclusively with the threaded portion 25 at the extreme bottom of the cylinder for mounting purposes, it should be understood that no limitation is intended thereby. The cylinder assembly 10 is capable of being mounted in a variety of ways, such as threads at the extreme top of the cylinder.

The cylinder assembly 10 includes a cylinder 34 and a piston 35 having a rod 36. The piston 35 is provided with appropriate upper 38 and lower 39 seals for the purpose of preventing fluid communication between head and rod end chambers of the piston and cylinder assembly.

A cap 40 enclosed the top of the cylinder 34 and provides a bearing type surface 41 through which the rod 36 extends. A seal is provided in the bearing surface 41 for preventing contaminants from entering the cylinder. The cap 40 is attached to the cylinder 34 by any suitable means such as corresponding threads.

The piston 35 is shown in a fully extended position in FIG. 2 as would be the case when the die and press are open. When the die is open, the pressurized fluid connected to the adapter 28 at the fitting 31 enters the cylinder 34 through an aperture 44 in the cylinder. The pressurized fluid forces the piston 35 to the top of the cylinder 34.

The piston 35 is shown in a fully retracted position in FIG. 3 as would be the case when the press has closed the die causing the workpiece or a die portion to force the piston 35 into the cyliner 34. In this case, the pressurized fluid is forced out of the cylinder 34 and back to the supply. Clearly, a vacuum, i.e. reduced pressure, would be created above the piston 35 in the rod end chamber as the piston is retracted into the cylinder 34 unless a vent is provided. As noted above, the prior art merely vents the rod end chamber to the atmosphere adjacent the press. The atmosphere adjacent a press is very likely to be contaminated by dirt, chips, shavings and fluids. The presence of such contaminants virtually guarantees that at least some degree of contamination can be expected to enter the cylinder 34.

As noted, the purpose of this invention is to eliminate even the possibility of contaminants entering the cylinder 34 through the vent. The means for accomplishing this objective is illustrated in FIGS. 2 and 3. An encircling manifold member, indicated generally at 46, is shown surrounding the cap 40 of the cylinder assembly 10. A vent (not shown in FIGS. 2 and 3) is provided through the cap 40 to the surface covered by the annular manifold member 46. The manifold member 46 is designed in such a way that a fitting 47 mounted at the circumference of the member is in open fluid communication with the vent (not shown) and thus the interior of the cylinder 34.

Figure 4:
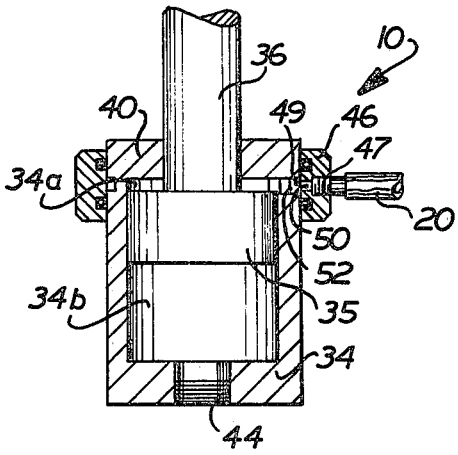
FIG. 4 is a schematic illustration (on a reduced scale) showing a cross-section of the cylinder assembly of the present invention.

FIG. 4 illustrates the manner in which the manifold member 46 is connected in fluid communication with a rod end chamber 34*a*. The manifold member 46 is generally circular with an inside dimension just slightly greater than the outside diameter of the cap 40. At one point, radially, about the circumference of the cap 40 a port (FIG. 5) 49 is provided through the cap. The manifold member 46 is likewise provided with a port 50 at one point, radially, about the member. The fitting 47 is secured within the port 50 as by threading.

If the position of the port 50 and fitting 47 were fixed relative to the cylinder assembly 10, much inconvenience would result from the numerous positions expected to be necessary within dies. In this regard, it is considerably advantageous to be able to position the fitting 47 at any point around the entire circumference of the encircling member.

Figure 5:
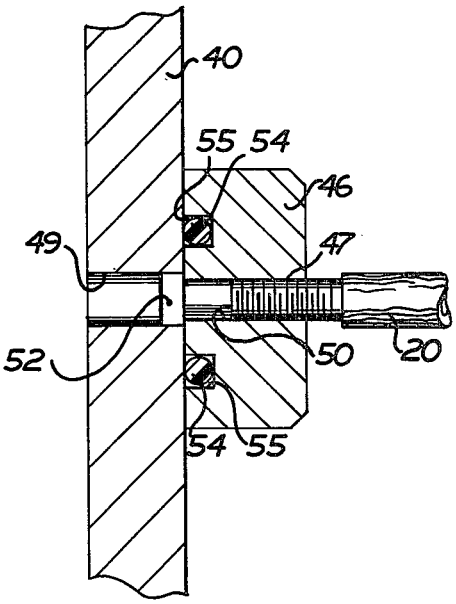
FIG. 5 is an enlarged illustration of a seal between a circular manifold and the cylinder of FIG. 4.

The instant invention attains the desired results by providing a circumferential slot 52 to connect the ports 49 and 50. FIG. 5 illustrates the circumferential slot 52 provided in the exterior circumference of the cap 40. The position of the circumferential slot 52 is at a distance from the top of the cap 40 corresponding to the port 49. In this manner, regardless of the radial position of the fitting 47 about the cylinder assembly 10, the port 50 is always in communication with the interior of the cylinder 34 by reason of the port 49 and circumferential slot 52.

Figure 7:
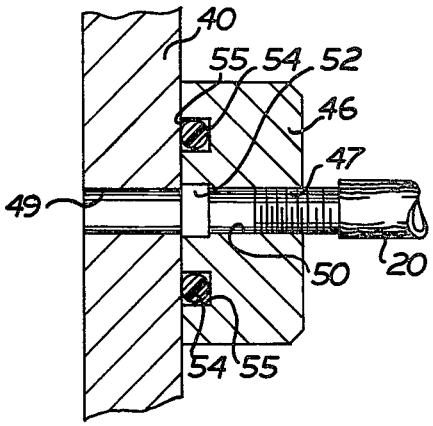
FIG. 7 is a view similar to that of FIG. 5 illustrating an alternate method of sealing engagement between the manifold member and the cylinder.

FIG. 7 illustrates the circumferential slot 52 provided in the interior circumference of the encircling member 46. Again, regardless of radial position, the fitting 47 and port 50 are always in communication with the interior of the cylinder 34 through the port 49 and circumferential slot 52.

Regardless of whether the circumferential slot 52 is located on the cap 49 or on the encircling member 46, the manifold member 46 must be provided with means to seal any leakage, into or out of, the cylinder 34. For this reason, sealing O-rings 54 are inserted within annular grooves 55 (FIGS. 5 and 7) provided in the inner surface of the encircling member 46 on each side of the circumferential slot 52.

Figure 6:
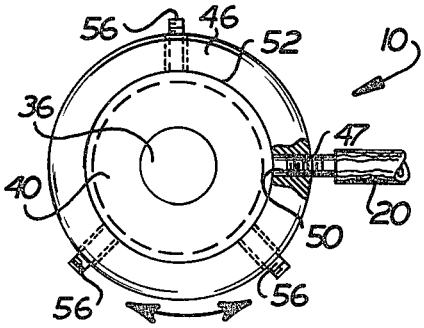
FIG. 6 is a top plan view taken along the line 6—6 of FIG. 4 to illustrate the attachment and positioning of the manifold member to the cylinder.

The adjustment of the fitting 47 to any radial position through the total 360°, is illustrated through the use of FIG. 6. As indicated by the arrow, the fitting 47 is capable of movement in either direction around the entire circumference of the cap 40. Once the fitting 47 has been properly positioned as desired or necessitated by the particular die, the manifold member 46 is locked in position by tightening screws 56 provided for that purpose through the member 46 and against the cap 40.

Figure 8:
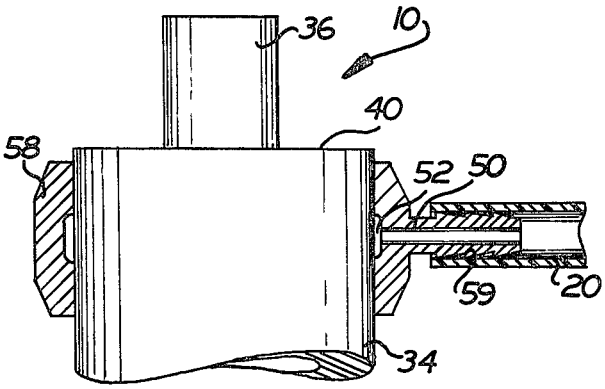
FIG. 8 is a diagrammatic illustration of another manifold member for use in association with the cylinder assembly of FIG. 4.

A modified manifold member 58 is shown in FIG. 8. The modified member 58 is constructed of a resilient or elastic material and is intended to be stretched over the cylinder assembly 10. Once installed on the cylinder assembly 10, the modified member 58 is such that a sealing engagement with the cylinder assembly is obtained without the necessity of additional seals, such as O-rings 54.

The modified manifold member 58 is provided with the circumferential slot 52 on its interior circumference for the purpose of assisting aligning the port 49 and the port 50 for fluid communication. An adapter 59 is provided integral with the member 58 for attaching the tube 20 leading to the clean atmosphere.

The modified manifold member 58 has one of its objectives, the retrofitting of cylinder assemblies known in the prior art. In this regard, the member 50 is readily fitted over an existing cylinder assembly, having a breather vent at the side, and provides relatively clean air to the cylinder without replacing or reconstructing the cylinder assembly.

Since the purpose of this invention is to avoid using the atmosphere in the immediate vicinity of the die or press, the fitting 47 or adapter 59 is shown (in each Figure) connected to the tube 20. If venting to a different atmosphere is merely required, the tube 20 may be open to a clean environment located some distance from the die. However, it is advantageous to connect the tube 20 to a supply of clean air (such as the pressurized air source 23 in FIG. 1) maintained at a relatively low pressure, e.g. 5 to 10 pounds per square inch. In such a case, all tubes 20 from cylinder assemblies are interconnected among themselves and to the source 23. The pressurized air source 23 assures a constant positive pressure at the rod end of the cylinder and discourages any contaminants from entering the cylinder.

In view of the foregoing, it is apparent that during operation of the press 9, the upper platen 12 is moved downwardly toward the lower platen 11 as the die set 15 forms the workpiece 16. At this time, the cushion cylinder assembly 10 applies a force to the workpiece 16 tending to hold it against movement relative to the upper die member. As the upper platen 12 moves downwardly, the piston 35 is moved downwardly in the cylinder 34. As this occurs, the rod end chamber **34*a* increases in volume and the head end chamber 34*b* (see FIG. 4) decreases in volume. Of course, the fluid under pressure in the head end chamber 34*b* resists downward movement of the piston 35. Although different fluids at different pressures may be utilized, in one embodiment of the invention the head end chamber 34*b*** contained nitrogen gas at 1500 p.s.i.

As the head end chamber **34*b* contracts and the rod end chamber 34*a* expands, relatively clean air or other fluid is supplied to the expanding rod end chamber 34*a* through the conduit 20. This air or other fluid is substantially free of particles which would be detrimental to the seals 83 and 39 disposed on the piston 35 to prevent a flow of high pressure fluid from the rod end chamber 34*b* to the head end chamber 34*a***.

The air or other fluid supplied to the expanding rod end chamber **34*a* is advantageously at a pressure slightly higher than atmospheric pressure. This results in the rod end chamber 34*a* being at a slightly higher pressure than the atmosphere of the environment around the press 9 so that foreign particles are not drawn into the expanding rod end chamber 34*a*. In fact, if a leak should tend to develop between the piston rod 36 and the seals 42, there would be a fluid flow from the rod end chamber 34*a*** to the atmosphere around the press and contaminants would not be drawn into the rod end chamber.

When the rod end chamber **34*a* is fully expanded in the manner shown in FIG. 3, the upper platen 12 is retracted and the relatively high pressure fluid in the head end chamber 34*b* causes the piston 35 to move upwardly from the position shown in FIG. 3 to the position shown in FIG. 2. As this occurs, the relatively clean air in the rod end chamber 34*a* is discharged back to the source from which it was originally supplied. In the embodiment of the invention illustrated in FIG. 1 this source of relatively clean air could also be the atmosphere at a location spaced apart from the press 9**.

It should be noted that the pressure in the tank 23 is only a few pounds above atmospheric pressure. The pressure of the nitrogen gas or other fluid supplied to the head end chamber **34*b* is substantially greater than atmospheric pressure. For example pressure in the head end chamber 34*b* might be approximately 1,500 pounds per square inch while the pressure of the clean air supplied to the rod end chamber 34*a* would be approximately 3 pounds per square inch. When pressure differentials such as these are present between the rod and head end chambers 34*a* and 34*b*, it is necessary for the seals 38 and 39 to be extremely fluid tight in order to prevent leakage of fluid between the head and end rod chambers. If contaminant particles, such as drawing compounds or small metal chips, were allowed to enter the rod end chamber 34*a* as it expanded during operation of the press, the operating life of the seals 38 and 39** would be substantially increased.

Having described specific preferred embodiments of the invention, the following is claimed:

1. A cylinder assembly to cushion the movement of a workpiece in a die in a press utilized in an environment which is contaminated by particles which are detrimental to the operation of the cylinder assembly, said cylinder assembly comprising a remote source of air at atmospheric pressure which is substantially free of contaminating particles which are detrimental to the operation of said cylinder assembly, a cylinder having opposite end portions, a piston disposed within said cylinder, said piston having a rod attached thereto and extending from a first one of said end portions of said cylinder, first sealing means between said cylinder and said piston, second sealing means between said first end portion of said cylinder and said rod, first and second variable volume chambers disposed between said end portions of said cylinder and said piston, means for connecting said first chamber with a source of fluid at a relatively high pressure, and means for connecting said second chamber with said source of air which is at atmospheric pressure and is substantially free of particles which are detrimental to the operation of said cylinder assembly, said means for connecting said second chamber with said source of air at atmospheric pressure including a port in said cylinder and flexible conduit means for connecting said port with said remote source of uncontaminated atmospheric air, said remote source of uncontaminated atmospheric air being spaced apart from said cylinder.

2. An assembly as set forth in claim 1 wherein said means for connecting said second chamber with said source of air at atmospheric pressure further includes an annular ring attached to said cylinder and cooperating therewith to define an annular chamber which circumscribes said cylinder and is connected in fluid communication with said port and with said flexible conduit means.

3. A cylinder assembly to cushion the movement of a workpiece in a die in a press, said cylinder assembly comprising a cylinder having opposite end portions, a piston disposed within said cylinder, and a piston having a rod attached thereto and extending from a first one of said end portions of said cylinder, first sealing means between said cylinder and said piston, second sealing means between said first end portion of said cylinder and said rod, first and second variable volume chambers disposed between said end portions of said cylinder and said piston, means for connecting said first chamber with a source of fluid at a relatively high pressure, and means for connecting said second chamber with a source of air which is substantially free of contaminating particles which are detrimental to the operation of said cylinder assembly, said means for connecting said second chamber with a source of air which is substantially free of contaminating particles including a first port in said cylinder and an annular ring having a second port, said annular ring being constructed of a resilient flexible material to enable said annular ring to be moved between a first position in which said annular ring flexibly engages an outside surface of said cylinder to form a fluid tight seal with the outside surface of said cylinder to thereby establish fluid communication between said first and said second ports and a second position in which said ring is free of engagement with said cylinder.

4. An assembly as set forth in claim 3 wherein said source of air which is substantially free of contaminating particle which are detrimental to the operation of said cylinder assembly includes a source of air which is at atmospheric pressure.

5. An assembly as set forth in claim 3 wherein said source of air which is substantially free of contaminating particles which are detrimental to the operation of said cylinder assembly includes a source of air which is at a pressure higher than atmospheric pressure.

* * * * *